United States Patent [19]

Popescu

[11] Patent Number: 4,643,805

[45] Date of Patent: Feb. 17, 1987

[54] GALVANIC BATH FOR THE ELECTRODEPOSITION OF BRIGHT ZINC-COBALT ALLOY

[76] Inventor: Francine Popescu, 27, rue de Centre, 94490 Ormesson, France

[21] Appl. No.: 836,952

[22] Filed: Mar. 6, 1986

[51] Int. Cl.[4] ..... C25D 3/56

[52] U.S. Cl. ..... 204/44.2

[58] Field of Search ..... 204/44.2, 44.5, 123

[56] References Cited

U.S. PATENT DOCUMENTS

| | | | |
|---|---|---|---|
| 4,252,619 | 2/1981 | DaFonte et al. | 204/55 R |
| 4,401,526 | 8/1983 | Martin | 204/44.2 |
| 4,439,283 | 3/1984 | Verbene et al. | 204/44.2 X |
| 4,543,166 | 9/1985 | Lash | 204/44.2 |

*Primary Examiner*—G. L. Kaplan

*Attorney, Agent, or Firm*—Gifford, Groh, VanOphem, Sheridan, Sprinkle and Dolgorukov

[57] ABSTRACT

A method and bath therefor for electroplating improved zinc base-cobalt containing alloys. The bath contains a brightening agent dispersed therein of a class of compounds having the formula:

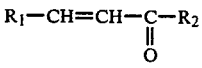

wherein $R_1$ represents an aromatic nucleus such as phenyl, pyridyl, naphthyl, thienyl or furyl which may have one or several substituents selected from hydroxy, chloro, amino, amido or methylenedioxy and $R_2$ is alkyl, hydroxyalkyl or pyridyl. The baths also contains conventional additives such as wetting agents and aromatic monocarboxylic acids or salts thereof. The baths generally have a pH range of 3.0 to 6.8.

12 Claims, No Drawings

GALVANIC BATH FOR THE ELECTRODEPOSITION OF BRIGHT ZINC-COBALT ALLOY

This invention relates to the electrodeposition of bright Zinc-cobalt alloy from an aqueous galvanic bath and, more particularly, to new compositions of bath additives for obtaining bright zinc-cobalt electro deposits.

It is known, in the art, to deposit zinc-cobalt alloys by utilising acid galvanic baths based on chlorides, of the same type of those used in the acid zinc electroplating and comprising, apart from the usual constituents, a cobalt salt.

The U.S. Pat. No. 4,439,283 describes the use of benzalacetone and triethanolamine or N-allylthiourea as brightening agents for obtaining a zinc-cobalt electrodeposit.

The Belgian patent Nr 893,543 describes the utilization of polyacrylamides and the U.S. patent Nr 4,401,526 describes the utilization of derivatives of beta-aminopropionic acid for the same purpose.

The present invention allows the production of bright electrodeposits of zinc-cobalt alloy comprising from 0.09 to 0.5% cobalt which present a high brilliance over a wide range of current densities, a good ductility and a high corrosion resistance, by utilizing a new combination of brightening agents in an aqueous galvanic bath. According to one aspect of this invention, galvanic deposits of zinc-cobalt alloy are obtained by making an object cathode in an acidic galvanic bath comprising essentially:

(a) an aqueous solution of zinc and cobalt (II) ions at a pH of between 3.0 and 6.8;

(b) a dispersing agent compatible with the said bath;

(c) a brightening agent dispersed in said bath of a chemical formula in accordance with the following general formula:

$$R_1-CH=CH-\underset{\underset{O}{\|}}{C}-R_2 \qquad (I)$$

wherein:

$R_1$ represents an aromatic nucleus: phenyl, pyridyl, naphthyl, thienyl or furyl which may have one or several substituents selected from hydroxy, chloro, bromo, alkyl, alkoxy, carboxy, amino, amido or methylenedioxy;

and $R_2$ is alkyl, hydroxyalkyl or pyridyl.

The concentration of the brightening agents of formula (I) in the electroplating bath for zinc-cobalt alloy electrodeposition is comprised between 0.05 and 2.0 grams per liter of bath, preferably between 0.1 and 0.7 g/l.

The Table I gives non limiting examples of compounds of formula (I) which may be utilized as brightening agents for the electrodeposition of zinc-cobalt alloy, according to the present invention.

TABLE I

COMPOUNDS OF FORMULA (I)

| COMPOUND | Optimal concentration in the zinc-cobalt bath g/l |
|---|---|
| (1) 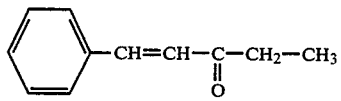 1-phenyl-1-penten-3-one | 0.1–0.4 |
| (2) 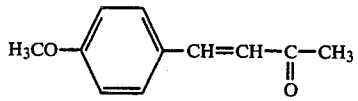 1-(p-methoxyphenyl)-1-buten-3-one | 0.05–0.3 |
| (3) 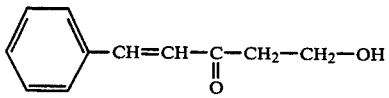 1-phenyl-5-hydroxy-1-penten-3-one | 0.1–0.4 |
| (4) 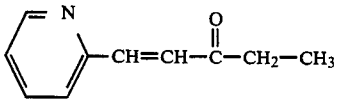 1-(2-pyridyl)-1-penten-3-one | 0.08–1.5 |
| (5) 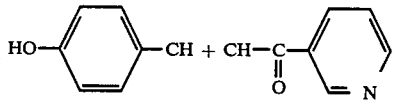 1-(p-hydroxyphenyl)-3-(3-pyridyl)-1-propen-3-one | 0.1–0.6 |
| (6) 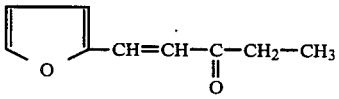 1-furyl-1-penten-3-one | 0.1–0.7 |
| (7) 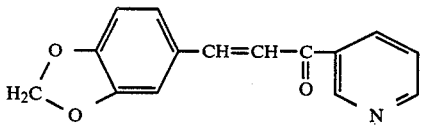 3-(-3-pyridyl)-1-piperonyl-1-propen-3-one | 0.05–0.4 |
| (8) 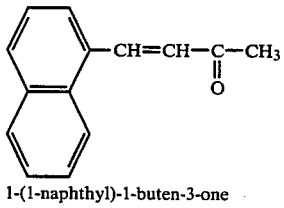 1-(1-naphthyl)-1-buten-3-one | 0.1–1.0 |
| (9) 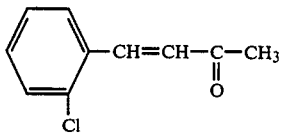 1-(o-chlorophenyl)-1-buten-3-one | 0.1–0.5 |

The brighteners of formula (I) being little or non soluble in water, one or several dispersing agents, compatible with the zinc-cobalt bath, are added to the electroplating bath of this invention, in order to form homogenous dispersions of the compounds of formula (I). According to this invention, one may utilize as dispersing agents the tensioactive agents and water soluble polymers belonging to the following classes of products:

A. nonionic or anionic wetting agents derived from ethylene or propylene oxide: ethoxylated alkylphenols, ethoxylated naphthol, ethoxylated fatty alcohols, ethoxylated oxoalcohols, ethylene oxide-propylene oxide copolymers, ethoxylated and sulfated fatty alcohols, ethoxylated and sulfated alkylphenols, ethoxylated amines;

B. amphoteric wetting agents of the class of alkylimidazolines;

C. water soluble synthetic polymers: polyethyleneglycols, polyproyleneglycols, polyvinylpyrrolidone, homopolymers of acrylamide, polyalkyleneimines, products of the condensation of naphthalene sulphonic acids with formaldehyde.

These dispersing agents are added in th zinc-cobalt bath in concentration of 0.1 to 30.0 grams per liter, preferably of 1.0 to 15.0 grams per liter of bath.

The Table 2 gives non limiting examples of dispersing agents which may be utilized according to the present invention:

TABLE 2

DISPERSING AGENTS

| COMPOUND | Optimal concentration in the zinc-cobalt bath g/l |
|---|---|
| (1) Ethoxylated nonylphenol with 15 moles ethylene oxide | 2–8 |
| (2) Ethoxylated beta-naphthol with 20 moles ethylene oxide | 4–12 |
| (3) Ethoxylated $C_{12}$–$C_{14}$ fatty alcohol with 11 moles ethylene oxide | 2–8 |
| (4) Ethoxylated ethyl-hexyl alcohol with 12 moles of ethylene oxide | 2–10 |
| (5) Ethoxylated oleyl alcohol with 12 moles of ethylene oxide | 3–9 |
| (6) Ethoxylated oleyl amine with 12 moles of ethylene oxide | 2–8 |
| (7) Ethoxylated and sulfated linear $C_{12}$–$C_{14}$ fatty alcohol with 20 moles of ethylene oxide | 2–8 |
| (8) Ethoxylated and sulfated octylphenol with 12 moles of ethylene oxide | 4–10 |
| (9) Ethylene oxide - propylene oxide copolymer with 80% ethylene oxide | 2–8 |
| (10) Polyethyleneglycol of molecular weight comprised between 200 and 15,000 | 3–10 |
| (11) Polyvinylpyrrolidone of molecular weight comprised between 5,000 and 360,000 | 1–6 |
| (12) Polyacrylamide of molecular weight comprised between 30,000 and 3,000,000 | 1–4 |
| (13) Polyethyleneimine of molecular weight comprised between 200 and 10,000 | 0.5–7 |
| (14) Condensation product of naphthalenesulfonic acid and formaldehyde of molecular weight comprised between 400 and 1200 | 0.5–4 |

The galvanic baths for the electrodeposition of zinc-cobalt alloys in conformity with this invention comprise:

(a) an aqueous solution of zinc ions and bivalent cobalt ions, i.e. an aqueous solution of a zinc salt such as zinc chloride, sulfate, sulphamate, acetate or fluoborate, in concentration of 10 to 200 grams per liter and of a bivalent cobalt salt such as cobalt chloride, sulfate, sulfamate, acetate or fluoborate in concentration of 1 to 50 grams per liter, preferably between 10 and 40 grams per liter of cobalt salt;

(b) a conducting salt, serving to increase the conductivity of the bath and selected from ammonium or alkaline chlorides (sodium chloride, potassium chloride, lithium chloride, ammonium chloride) in concentration of 10 to 200 grams per liter;

(c) a substance acting as buffer for stabilizing the pH of the bath such as boric acid, citric acid, tartaric acid or glyceroboric acid, in concentration of 1 to 50 grams per liter;

(d) one or several dispersing agents, compatible with the said bath, such as described above, in total concentration of 0.1 to 30.0 grams per liter;

(e) a brighter of formula (I), dispersed in said bath, in concentration of 0.05 to 2.0 grams per liter of bath.

The pH of the zinc-cobalt bath is, preferably, comprised between 4.5 and 5.5, but may vary from 3.0 to 6.8. In order to obtain a certain variation of the qualities of the zinc-cobalt electrodeposit and, particularly, in order to increase the uniformity of the deposit, the brighteners and additives described above are associated, in the zinc-cobalt bath, with aromatic monocarboxylic acids having the carbonyl group directly bonded to the aromatic nucleus. These acids respond to the general formula:

$$R_A-\underset{\underset{O}{\|}}{C}-O.Me \qquad \text{(II)}$$

ps wherein: $R_A$ represents a phenyl, pyridyl, furyl, thienyl or naphthyl radical which may comprise one or several substituents such as hydroxy, alkoxy, alkyl amino, amido, chloro, bromo, methylenedioxy or carbonyl $$(-\underset{\underset{O}{\|}}{C}-H)$$

and Me is hydrogen, an alkaline metal, ammonium, zinc or cobalt.

The concentration of these aromatic acids or their salts in the zinc-cobalt bath may vary between 0.1 to 20 grams per liter and, preferably, between 1.0 and 6.0 g/l.

Non limiting examples of acids of formula (II) are the following: benzoic acid, anisic acid, nicotinic acid, furoic acid, thenoic acid, vanillic acid, piperonylic acid, salicylic acid, terephtalic acidaldehyde or their sodium, potassium lithium, ammonium, zinc or cobalt salts.

In order to obtain bright zinc-cobalt electrodeposits according to this invention, a metallic object is made cathode in the above dexcribed bath, at a cathodic current density comprised between 0.5 and 4.0 A/dm$^2$ and utilizing a zinc anode.

According to the known techniques of acid zinc electroplating, a cathodic mechanical agitation or an air agitation is applied.

According to another object of the present invention, it has been found that the range of cathodic current densities under which a bright-zinc-cobalt alloy deposition is obtained may be significantly enlarged by the addition, in the above described bath, of at least one aliphatic aminated water soluble polymer compatible with said bath, said aminated polymer being the product of the reaction of an aliphatic amine or polyamine with an epihalohydrin or a dihalohydrin.

The concentration of this polymer in the galvanic zinc-cobalt bath is comprised between 0.5 and 50 g/l and, preferably, between 1 and 20 g/l.

The preparation of these polymers is known and consists in reacting, in a polar solvent, an epihalohydrin or a dihalohydrin with ammonia or a primary or secondary aliphatic amine or with an aliphatic polyamine. As epihalohydrin, one may use epichlorohydrin or epibromohydrin and, as dihalohydrin, dichlorohydrin or dibromohydrin.

A great number of aliphatic amines or polyamines may be utilized to obtain the aliphatic aminated polymers which may be utilized as additives in the galvanic baths for the electrodeposition of bright zinc-cobalt alloys, in accordance to this invention.

The following are non limiting examples of aliphatic amines or polyamines suitable for the preparation of said polymers: methylamine, dimethylamine, ethylamine, diethylamine, monoethanolamine, diethanolamine, n-propylamine, ethylenediamine, monoisopropanolamine, aminoethylethanolamine, 3-aminopropanol, propylenediamine, diethylenetriamine, triethylenetetramine, tetraethylenepentamine.

The reactant ratio is from 0.5 to 1.5 molar and, preferably, equimolar. A molar ratio between the epihalohydrin and the amine superior to 1.5 is to be avoided, as the excess of epihalohydrin may lead to the formation of ramified polymers, which may easily reticulate and are not favorable to the electrodeposition of zinc-cobalt alloys.

The reaction is performed, according to the known techniques, in aqueous or alcoholic medium and at a temperature comprised between 50° and 100° C.

At the end of the condensation reaction, the polymer solution obtained is neutralized at pH 5–7 with hydrochloric acid, in order to avoid that the polymer reticulate with the time.

The following examples illustrate, in a non limiting manner, the realization of this invention:

EXAMPLE 1

A zinc-cobalt bath of the following basic composition is prepared:

Zinc chloride ($ZnCl_2$): 80 g/l
Cobalt chloride ($CoCl_2.6H_2O$: 30 g/l
Potassium chloride (KCl): 190 g/l
Boric acid ($H_3BO_3$): 30 g/l and the pH of this bath is corrected to 4.7.

EXAMPLE 2

In the zinc-cobalt bath of example 1, there is added:

Compound No. 1 of Table 2: 8g/l
Compound No. 6 of Table 2: 2 g/l
Compound No. 1 of Table 1: 0.3 g/l
Sodium benzoate: 3 g/l The electrodeposition is performed in a Hull cell at a total current of 1.5 A, during 10 minutes, under agitation; a zinc anode is used and the cathode is a steel panel degreased and pickled. A bright and uniform zinc-cobalt electrodeposit is obtained in the current density zone comprised between 0.1 and 4.0 A/dm$^2$; between 4 and 6 A/dm$^2$ the deposit is dull and of dark colour.

An object made of steel is made cathode in a galvanic bath having the composition of this example; a current of 2 A/dm$^2$ is applied during 10 minutes, under agitation, at a temperature of 25° C. A uniform and bright zinc-cobalt deposit is obtained, which, analyzed, has a concentration in cobalt of 0.1%. After being chromated during 25 seconds in a chromating bath comprising 2.5 g/l hexavalent chromium $Cr^{6+}$,1.3 g/l $SO_4^{--}$, 0.3 g/l $Cr^{3+}$ and 2 g/l $NO_3^-$ at a pH of 1.7, the zinc-cobalt deposits obtain according to this example show a corrosion resistance of minimum 400 hours to the standardized neutral salt spray test.

EXAMPLE 3

Preparation of an aliphatic aminated polymer:

In a reactor are introduced 61.1 g (1 mole) monethanolamine and 231 g of water; the solution is heated at 50° C. and 92.5 g (1 mole) of epichlorohydrin are added, drop by drop and under agitation, so that the temperature of the mixture is not exceeding 65° C.

After all epichlorohydrin is added, the mixture is kept one hour at 65° C. and 2 hours at 100° C. under agitation and reflux.

After cooling at room temperature, the pH of the solution is corrected at 6.0 with hydrochloric acid.

The solution of aliphatic aminated polymer obtained in ths way is utilized as additive for the zinc-cobalt electroplating bath, according to this invention.

EXAMPLE 4

Preparation of an aliphatic aminated polymer:

In a reactor are introduced 103.1 g (1 mole) of diethylenetriamine and 400 g of water and the temperature of the mixture is set at 45° C. Under agitation, 102 g (1.1 mole) of epichlorohydrin are added, drop by drop, maintaining the temperature of the reacting mixture at 60° C. by cooling. When all the epichlorhohydrin has been added, the solution is heated at 100° C. during 3 hours, under reflux and agitation.

After cooling at room temperature, the pH of the solution is corrected at 5.8 with hydrochloric acid. The solution of aliphatic aminated polymer obtained in this way is utilized as additive for the zinc-cobalt electroplating bath in conformity with this invention.

EXAMPLE 5

Preparation of an aliphatic aminated polymer:

75.1 g (1 mole) of monoisopropanolamine and 250 g of water are introduced in a reactor; the solution is heated at 55° C. and 116 g (0.9 mole) of alpha-dichlorohydrin are added slowly, so that the temperature of the reacting mixture is not exceeding 70° C.

When all the alpha-dichlorohydrin has been added, the temperature is maintained at 70° C. during 1 hour and, afterwards, 3 hours at 100° C. under agitation and reflux. After cooling at room temperature, the pH of the solution is corrected at 5.5 with hydrochloric acid. This solution of aliphatic aminated polymer is utilized as additive for the zinc-cobalt electroplating bath, in conformity with this invention.

EXAMPLE 6

In the bath of example 1 there is added:

Compound No. 4 of Table 2: 6 g/l
Compound No. 8 of Table 2: 1 g/l
Ethoxylated coco fatty amine with 25 moles of ethylene oxide: 1 g/l
Polyethylene glycol of molecular weight 6000: 3 g/l
Condensation product of naphthalenesulphonic acid with formaldehyde of molecular weight 400: 2 g/l
Sodium benzoate: 2 g/l
Anisic acid: 1 g/l
Compound No. 1 of Table 1: 0.25 g/l Solution of aminated polymer according to example 3: 3 g/l The pH of the bath is corrected at 4.5–4.8 and its temperature at 25° C.

The electrodeposition is realized in a Hull cell at a total current of 2 A, during 10 minutes, under agitation; the anode is made of zinc and the cathode is a steel panel.

A bright, uniform and ductile zinc-cobalt electrodeposit is obtained in the zone of current densities of 0.1 to 0.7 A/dm$^2$.

Steel objects made cathode in the bath of this example, at an average current density of 4 A/dm$^2$, present a zinc-cobalt deposit very brilliant, uniform and ductile and having a cobalt content of 0.1 to 0.15%. This deposit may be easily chromated in the chromating solutions known for the chromating of zinc and, after chromation, shows a high corrosion resistance.

EXAMPLE 7

A zinc-cobalt bath of the following composition is prepared:

Zinc chloride ($ZnCl_2$): 75 g/l
Cobalt chloride ($CoCl_2.6H_2O$: 35 g/l
Potassium chloride (KCl): 170 g/l
Ammonium chloride ($NH_4Cl$): 20 g/l
Boric acid ($H_3BO_3$): 25 g/l
Sulfated ethoxylated nonylphenol with 20 moles e.o.: 4 g/l
Ethoxylated nonylphenol with 40 moles e.o. 2 g/l
Compound No 6 of Table 2: 1 g/l
Polyethyleneglycol of molecular weight 9000 1.5 g/l
Compound No. 2 of Table 1: 0.1 g/l
Benzalacetone: 0.2 g/l
Solution of aliphatic aminated polymer as per Example 5: 2 g/l
Sodium salicylate: 1 g/l
Sodium benzoate: 2.5 g/l Working at 20° C., pH=4.8 and at cathodic current densities comprised between 2.0 and 6.0 A/dm$^2$, there are obtained very bright, levelled, uniform and ductile zinc-cobalt deposits having a cobalt content of 0.15–0.18%. After chromic passivation, these deposits show a high corrosion resistance.

The present invention is not limited to the above examples, numerous other variants being realizable by the man of the art, by applying the general formulae (I) and (II) and the indications given in this description.

What I claim is:

1. A galvanic bath for electrodepositing a bright zinc-cobalt alloy comprising:

(a) an aqueous acidic solution of zinc and cobalt ions;

(b) 0.1 to 30 grams per liter of a dispersing agent compatible with said bath;

(c) 0.05 to 2.0 grams per liter of a brightening agent of general formula:

$$R_1-CH=CH-\underset{\underset{O}{\|}}{C}-R_2 \qquad (I)$$

wherein:

$R_1$ represents phenyl, pyridyl, naphthyl, thienyl or furyl radical which may be substituted by one or more substituents selected from chlorine and bromine atoms or a hydroxy, alkyl, alkoxy, carboxy, amino, amido or methylenedioxy group; and $R_2$ is alkyl, hydroxyalkyl or pyridyl and (d) 0.1 to 20 grams per liter of an aromatic monocarboxylic acid with the carboxy group directly linked to the aromatic nucleus, or a salt thereof.

2. A zinc-cobalt electroplating bath as claimed in claim 1, wherein said brightening agent is 1-phenyl-1-penten-3-one.

3. A zinc-cobalt electroplating bath as claimed in claim 1, wherein said brightening agent is 1-(o-chlorophenyl)-1-buten-3-one.

4. A zinc-cobalt electroplating bath as claimed in claim 1, wherein said dispersing agent is a non ionic wetting agent derived from ethylene oxide.

5. A zinc-cobalt electroplating bath as claimed in claim 1, wherein said dispersing agent is selected from the following compounds: ethoxylated nonylphenol with 15 moles ethylene oxide; ethoxylated ethyl-hexyl alcohol with 12 moles of ethylene oxide; ethoxylated oleylamine with 12 moles ethylene oxide; ethylene oxide; ethoxylated and sulfated octylphenol with 20 moles ethylene oxide; polyethylene glycol of molecular weight comprised between 200 and 15,000.

6. A zinc-cobalt electroplating bath as claimed in claim 1, wherein said aromatic acid is selected from the following acids: benzoic acid, anisic acid, nicotinic acid, salicylic acid, terephtalic acid-aldehyde.

7. A zinc-cobalt electroplating bath as claimed in claim 1, which further contains a conducting salt selected from alkaline metal chlorides or ammonium chloride.

8. A zinc-cobalt electroplating bath as claimed in claim 1, which further comprises 0.5 to 50 grams per liter of a water soluble aliphatic aminated polymer compatible with said bath.

9. A zinc-cobalt electroplating bath as claimed in claim 8, wherein said aliphatic aminated polymer is the product of the reaction of an aliphatic amine or polyamine with an epihalohydrin or a dihalohydrin.

10. A zinc-cobalt electroplating bath as claimed in claim 9, wherein said aliphatic aminated polymer is the product of the reaction of monoethanolamine with epichlorohydrin.

11. A zinc-cobalt electroplating bath as claimed in claim 9, wherein said aliphatic ainated polymer is the product of the reaction of monoisopropanolamine with epichlorohydrin.

12. A process for electrodepositing zinc-cobalt alloy wherein an object is made cathode in an electroplating bath as claimed in claim 1.

* * * * *

UNITED STATES PATENT AND TRADEMARK OFFICE

CERTIFICATE OF CORRECTION

PATENT NO. : 4,643,805

DATED : February 17, 1987

INVENTOR(S) : Francine Popescu

It is certified that error appears in the above-identified patent and that said Letters Patent is hereby corrected as shown below:

IN THE ABSTRACT:

Fourth line after the formula, after "chloro,", insert --bromo, alkyl, alkoxy, carboxy,--.

Fifth line after the formula, delete "baths" and insert --bath--.

Seventh line after the formula, delete "baths" and insert --bath--.

Eighth line after the formula, delete "have" and insert --has--.

IN THE SPECIFICATION:

Column 1, line 14, delete "utilising" and insert --utilizing--;

line 23, delete "Nr" and insert --No--;

line 25, delete "Nr" and insert --No--.

UNITED STATES PATENT AND TRADEMARK OFFICE

CERTIFICATE OF CORRECTION

PATENT NO. : 4,643,805

DATED : February 17, 1987

INVENTOR(S) : Francine Popescu

It is certified that error appears in the above-identified patent and that said Letters Patent is hereby corrected as shown below:

Column 2, in formula 5 between lines 31 and 34, delete "+" and insert -- = -- (double bond).

Column 3, line 13, after "phenols,", insert --and--;

line 15, after "imidazolines;", insert --or--;

line 20, delete "phonic" and insert --fonic--;

line 21, delete "th" and insert --the--;

line 65, delete "sulphamate" and insert --sulfamate--.

Column 4, in the formula between lines 28 and 31, delete "O.Me" and insert --O-Me--;

line 32, delete "ps";

line 34, after "alkyl", insert --,--;

UNITED STATES PATENT AND TRADEMARK OFFICE

CERTIFICATE OF CORRECTION

PATENT NO. : 4,643,805

DATED : February 17, 1987

INVENTOR(S) : Francine Popescu

It is certified that error appears in the above-identified patent and that said Letters Patent is hereby corrected as shown below:

Column 4, line 50, delete "terephtalic" and insert --terephthalic--;

line 54, delete "dexcribed" and insert --described--.

Column 5, line 15, delete "to" and insert --with--;

line 45, after "$6H_2O$" and before ":", insert --)--;

line 63, delete "cathode" and insert --cathodic--.

Column 6, line 4, delete "obtain" and insert --obtained--;

line 19, delete "at" and insert --to--;

line 36, delete "at" and insert --to--;

line 52, delete "at" and insert --to--;

UNITED STATES PATENT AND TRADEMARK OFFICE

CERTIFICATE OF CORRECTION

PATENT NO. : 4,643,805

DATED : February 17, 1987

INVENTOR(S) : Francine Popescu

It is certified that error appears in the above-identified patent and that said Letters Patent is hereby corrected as shown below:

Column 6, line 64, delete "naphthalenesulphonic" and insert --naphthalenesulfonic--.

Column 7, line 3, delete "at" and insert --to--;

line 12, delete "0.7" and insert --7.0--;

line 26, after "$6H_2O$" and before ":", insert --)--;

line 31, delete "e.o." and insert --ethylene oxide--;

line 33, delete "e.o." and insert --ethylene oxide--;

line 35, after "9000" insert --:--.

Column 8, line 11, delete ";" and insert --,--;

line 12, after "pyridyl", insert --;--;

UNITED STATES PATENT AND TRADEMARK OFFICE

CERTIFICATE OF CORRECTION

PATENT NO. : 4,643,805

DATED : February 17, 1987

INVENTOR(S) : Francine Popescu

It is certified that error appears in the above-identified patent and that said Letters Patent is hereby corrected as shown below:

Column 8, line 36, delete "terephtalic" and insert --terephthalic--;

line 59, delete "cathode" and insert --cathodic--.

Signed and Sealed this

Eighteenth Day of August, 1987

*Attest:*

*Attesting Officer*

DONALD J. QUIGG

*Commissioner of Patents and Trademarks*